US005101167A

United States Patent [19]

Ikegami

[11] Patent Number: 5,101,167

[45] Date of Patent: Mar. 31, 1992

[54] ACCELERATOR VACUUM PIPE HAVING A LAYER OF A GETTER MATERIAL DISPOSED ON AN INNER SURFACE OF THE PIPE

[75] Inventor: Kazunori Ikegami, Amagasaki, Japan

[73] Assignee: Mitsubishi Denki Kabushiki Kaisha 2-3, Tokyo, Japan

[21] Appl. No.: 605,760

[22] Filed: Oct. 30, 1990

[30] Foreign Application Priority Data

Nov. 1, 1989 [JP] Japan ..... 1-286191

[51] Int. Cl.[5] ..... H05H 13/04

[52] U.S. Cl. ..... 328/233; 328/235; 445/55; 445/58

[58] Field of Search ..... 328/233, 235; 313/553; 29/458; 228/149; 445/58

[56] References Cited

U.S. PATENT DOCUMENTS 3,554,150 1/1971 Goetshins ..... 228/149 X
4,751,470 7/1988 Ikegami et al. ..... 328/233
4,853,640 8/1989 Matsumoto et al. ..... 328/235
4,992,746 2/1991 Martin ..... 328/235

FOREIGN PATENT DOCUMENTS 1489409 3/1969 Fed. Rep. of Germany ..... 313/553
62-276800 of 1987 Japan .
1-60000 6/1989 Japan ..... 328/233
1433431 4/1976 United Kingdom ..... 228/149

*Primary Examiner*—Donald J. Yusko
*Assistant Examiner*—Ashok Patel
*Attorney, Agent, or Firm*—Morrison Law Firm

[57] ABSTRACT

An accelerator vacuum pipe for a charged-particle acceleration and storage system having a vacuum zone defined therein is provided with a layer of getter material which can capture residual or generated gas molecules in the pipe-member. The layer of getter material is disposed over the entire inner wall of the vacuum pipe in at least a deflection zone where the charged-particles are deflected.

15 Claims, 4 Drawing Sheets

ACCELERATOR VACUUM PIPE HAVING A LAYER OF A GETTER MATERIAL DISPOSED ON AN INNER SURFACE OF THE PIPE

This invention relates to a vacuum pipe of an accelerator of a charged-particle acceleration and storage system for use in, for example, generating synchrotron radiation light (SOR) and more particularly to such a vacuum pipe having a higher degree of vacuum so as to provide a longer life for charged particles.

BACKGROUND OF THE INVENTION

FIGS. 1 and 2 illustrate a portion of a conventional SOR generator disclosed, for example, in Japanese Unexamined Patent Publication No. SHO 62-276800. FIG. 1 shows a transverse cross-section of a portion of a vacuum pipe of the SOR generator where deflection magnets (not shown) are disposed, and FIG. 2 schematically shows a longitudinal cross-section of the portion of the vacuum pipe shown in FIG. 1.

In FIGS. 1 and 2, the reference numeral 1 denotes the vacuum pipe through which charged particles travel along an orbit 2. When charged particles which are traveling at a speed comparable with the speed of light are deflected, SOR 3 is generated in a direction tangent to the orbit 2 and impinges on the inner wall of the vacuum pipe 1 at a position 4. A bulk getter 5 is disposed at the SOR impinging position 4. The material for the bulk getter 5 may be, for example, zirconium or a zirconium alloy, such as Zr-Al and Zr-V-Fe.

In the conventional vacuum pipe of the above-described structure, the provision of the bulk getter 5 can suppress release of desorbed gas which would occur if the SOR 3 impinged directly on the structural material of the vacuum pipe 1. Impurities contained in the bulk getter 5 are ionized by the SOR 3 or by excited electrons generated by the SOR 3, and the thus produced ions diffuse inward of the bulk getter 5, whereby release of gas, desorbed in response to excitation by radiation, from the surface can be greatly suppressed. If the rate of ion diffusion into the bulk getter 5 is higher than the rate of generation in the bulk getter 5 of the ions due to excitation by radiation, the bulk getter 5 as a whole acts as an exhaust pump and, accordingly, can not only completely suppress the release of gas desorbed by radiation-excitation but also adsorb residual gas within the vacuum pipe 1.

In the above-described accelerator vacuum pipe 1, the bulk getter 5 is disposed only at the SOR radiation impinging position 4 and in its vicinity. This arrangement cannot provide adequate suppression of outgassing in other portions where the bulk getter 5 is not disposed, and, accordingly, the pressure within the vacuum pipe increases and the life of the stored charged-particles decreases.

The object of the present invention is to provide an accelerator vacuum pipe free of the above-described defects of the conventional vacuum pipe. According to the present invention, the vacuum pipe can be maintained at an ultra-high vacuum whereby a long storage life of charged particles can be obtained.

SUMMARY OF THE INVENTION

An accelerator vacuum pipe according to the present invention which defines therein a vacuum space through which charged particles travel in an orbit includes a layer of getter material which can capture residual or generated gas molecules within the pipe. The getter material layer is disposed over the entire inner wall of the vacuum pipe at least in a deflection zone where the charged particles are deflected. Preferably, the getter material layer is disposed over the entire inner wall of the entire vacuum pipe.

DETAILED DESCRIPTION OF PREFERRED EMBODIMENTS

Figure 3:
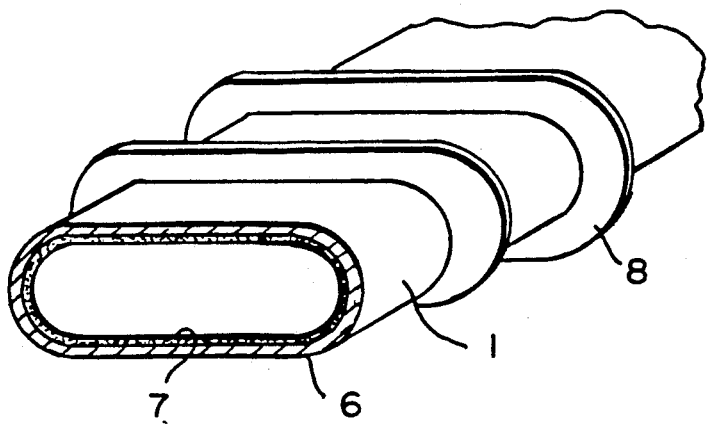
FIG. 3 is a perspective view of a portion of an accelerator vacuum pipe according to one embodiment of the present invention, in which a cross-section is shown.
Figure 4A:
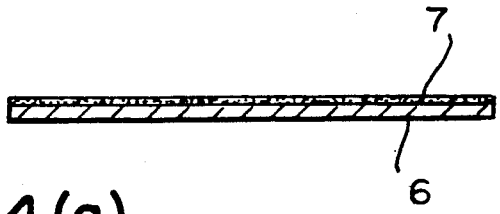
FIGS. 4(*a*) and 4(*b*) illustrate how to make the accelerator vacuum pipe of FIG. 3.
Figure 4B:
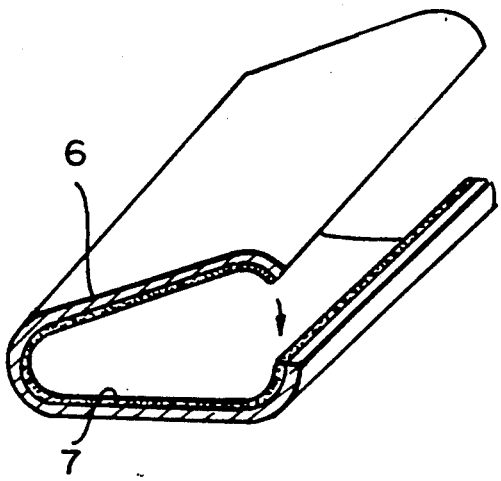

FIG. 3 shows a cross-section of a portion of an accelerator vacuum pipe according to one embodiment of the present invention, and FIGS. 4(*a*) and 4(*b*) show steps of making the vacuum pipe 1 of FIG. 3. Referring to FIG. 4(*a*), a sheet 6 of structural material of, for example, stainless steel or aluminum has its one surface coated with a layer 7 of getter material. The structural material sheet 6 with the layer 7 of getter material disposed on one surface thereof is bent, with the layer 7 facing inward, in such a manner as to form a pipe shape having a race-track shaped cross-section, as shown in FIG. 4(*b*). Abutting edges of the bent sheets 6 are joined, and reinforcing ribs 8 are attached to mechanically reinforce the structure. Thus, the accelerator vacuum pipe 1 shown in FIG. 3 results.

The getter material layer 7 is disposed to overlie the entire wall of the pipe 1 rather than to overlie only portions where SOR impinges as in the aforementioned conventional vacuum pipe 1. The vacuum pipe 1 is heated to activate the getter material. Then the getter material layer 7 adsorbs and exhausts the gas within the vacuum pipe 1 to keep the ultra-high vacuum in the pipe 1.

Figure 5:
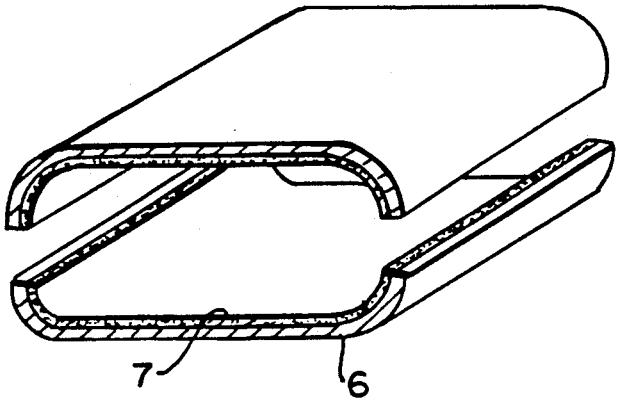
FIGS. 5 through 8 are perspective views of various accelerator vacuum pipes according to other embodiments of the present invention.

FIG. 5 shows another embodiment of the vacuum pipe 1 of the present invention. Two structural material sheets 6 with respective getter material layers 7 disposed on one surfaces thereof are bent to form two halves, which are butt-joined together along their abutting edges to thereby form a pipe having a race-track shaped cross-section.

Figure 6:
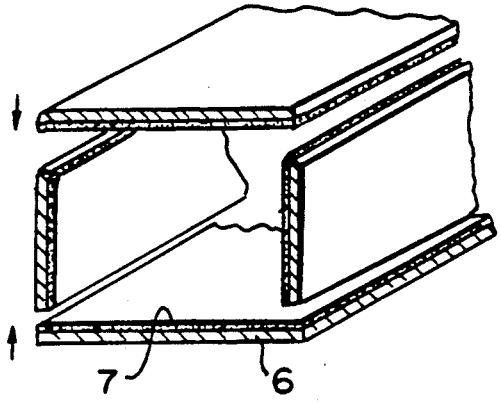

FIG. 6 shows a vacuum pipe 1 according to a third embodiment of the present invention, which comprises four structural sheets 6 having respective getter material layers 7 thereon. The four sheets 6 are joined together along their adjoining edges.

Figure 7:
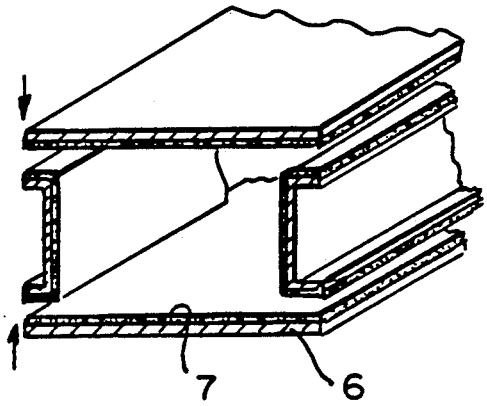

FIG. 7 shows a vacuum pipe 1 according to a fourth embodiment of the present invention, which, as the vacuum pipe of FIG. 6, comprises four sheets joined together at four corners. However, in this embodiment, U-shaped sheets with their limbs extending outward are used as the side sheets. The use of U-shaped sheets provides a larger area available for joining the sheets, which not only facilitates the working for joining the two side sheets to the top and bottom sheets, but also provides strong joints.

Figure 8:
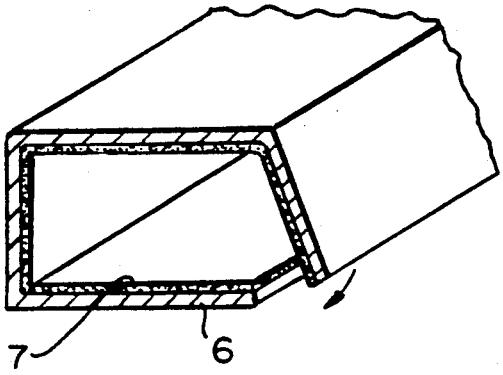

FIG. 8 shows a fifth embodiment of the present invention. A vacuum pipe 1 according to this embodiment is formed of a structural material sheet 6 with a layer 7 of getter material disposed on one surface thereof, which is bent three times as shown so that the two edges of the sheet adjoin each other. The adjoining edges are joined together.

The cross-sectional shape of the vacuum pipe 1 of the present invention is not limited to the illustrated racetrack or rectangular shapes, but it may be elliptical or circular.

Figure 9:
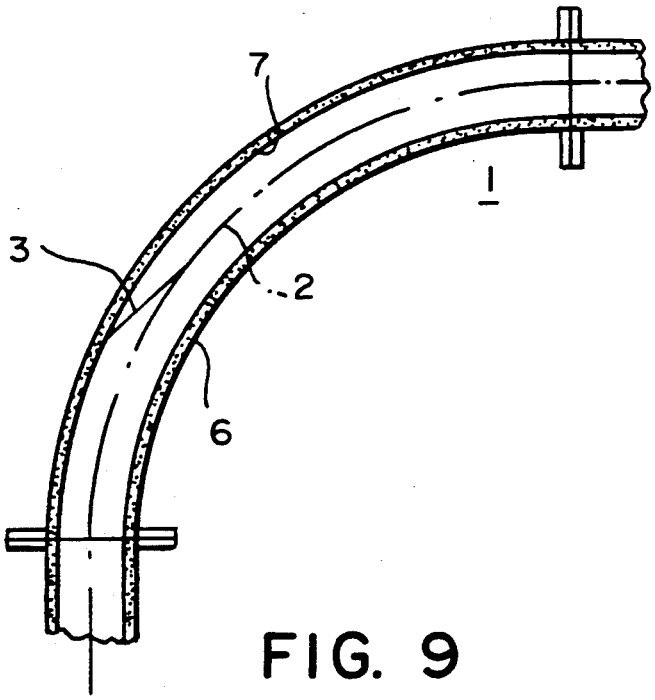
FIG. 9 schematically shows a logitudinal cross-section of a portion of the vacuum pipe according to the present invention.

In addition, although the getter material layer 7 is described and shown to overlie the entire inner wall of the entire vacuum pipe 1, as illustrated in FIG. 9, it may be disposed to overlie the entire inner wall portion at least in the deflection zone of the pipe 1 where charged-particles are deflected, so that the vacuum pipe 1 can be maintained at an ultra-high vacuum.

As described above, according to the present invention, the entire inner wall of at least the charged-particle deflecting zone of an accelerator vacuum pipe 1, or, more preferably, the entire inner wall of the entire vacuum pipe 1, is coated with a layer of getter material which can capture residual or generated gas molecules within the pipe 1. With this arrangement, the vacuum pipe 1 can be maintained at an ultra-high vacuum so that the life of stored charged particles can be extended.

What is claimed is:

1. An accelerator vacuum pipe, comprising:
a vacuum space in said accelerator vacuum pipe through which charged particles can travel in an orbit;
a layer of getter material in said vacuum space, said getter material being of a type which can capture residual or generated gas molecules within said accelerator vacuum pipe; and
said getter material being disposed over an entire inner wall of said accelerator vacuum pipe in at least a deflection zone where said charged particles are deflected.

2. An accelerator vacuum pipe according to claim 1 wherein:
said accelerator vacuum pipe includes a sheet of structural material bent to form said accelerator vacuum pipe;
edges of said structural material adjoining each other;
said layer of a getter material disposed on a surface of said structural material that forms an inner surface of said accelerator vacuum pipe; and
said edges being joined.

3. An accelerator vacuum pipe according to claim 1 wherein:
said accelerator vacuum pipe includes a plurality of structural material sheets joined to form said accelerator vacuum pipe;
said layer of a getter material being disposed on a surface of each said structural material sheets that form an inner surface of said accelerator vacuum pipe;
said structural material sheets being bent;
edges of said structural material adjoining each other; and
said edges being joined.

4. An accelerator vacuum pipe according to claim 2 wherein said adjoining edges of said bent structural material sheets are butt-joined.

5. An accelerator vacuum pipe according to claim 3 wherein said adjoining edges of said bent structural material sheets are butt-joined.

6. An accelerator vacuum pipe according to claim 2 wherein a cross-section of said accelerator vacuum pipe is race track shaped; and
said cross-section being along a plane transverse to an orbit of said charged particles.

7. An accelerator vacuum pipe according to claim 3, wherein a cross-section of said accelerator vacuum pipe is race track shaped; and
said cross-section being along a plane transverse to an orbit of said charged particles.

8. An accelerator vacuum pipe according to claim 2, wherein a cross-section of said accelerator vacuum pipe is a rectangle; and
said cross-section being along a plane transverse to an orbit of said charged particles.

9. An accelerator vacuum pipe according to claim 3, wherein a cross-section of said accelerator vacuum pipe is a rectangle; and
said cross-section being along a plane transverse to an orbit of said charged-particles.

10. An accelerator vacuum pipe according to claim 9, wherein:
said rectangular shape is made up of four walls;
each of said four walls being formed of a sheet of said structural material;
edges of said four walls being joined along their respective edges to form four joined corners;
said joined corners having edges extending outward at each of said four joined corners; and
said layer of said getter material disposed along an entire inner surface of each said wall.

11. An accelerator vacuum pipe according to claim 10 wherein:
two of said structural material sheets are mutually facing flat sheets and a remaining two of said structural material sheets are mutually facing U-shaped sheets;
said U-shaped sheets having legs extending outwardly from said accelerator vacuum pipe;
flat surfaces of said two flat sheets abutting said legs;
abutting surfaces of said two flat sheets being joined to said legs, whereby said two flat sheets are mutually spaced apart by said two U-shaped sheets to form said accelerator vacuum pipe having a rectangular cross-section; and
said layer of getter material being disposed along an entire inner surface of each of said walls.

12. An accelerator vacuum pipe according to claim 1, further comprising:
a plurality of reinforcing ribs for reinforcing said accelerator vacuum pipe; and
said reinforcing ribs disposed laterally around said accelerator vacuum pipe.

13. An accelerator vacuum pipe according to claim 1, wherein said layer includes an entire surface of said inner wall.

14. An accelerator vacuum pipe according to claim 2, further comprising:
a plurality of reinforcing ribs for reinforcing said accelerator vacuum pipe; and
said reinforcing ribs disposed laterally around said accelerator vacuum pipe.

15. A method for producing an accelerator vacuum pipe, comprising:
coating a surface of a structural sheet with a layer of a getter material;
forming said structural sheet into said accelerator vacuum pipe with said surface on the inside of said accelerator vacuum pipe; and
sealing abutting edges of said structural sheet.

* * * * *

UNITED STATES PATENT AND TRADEMARK OFFICE

CERTIFICATE OF CORRECTION

PATENT NO. : 5,101,167

DATED : March 31, 1992

INVENTOR(S) : Kazunori Ikegami

Figure 1:
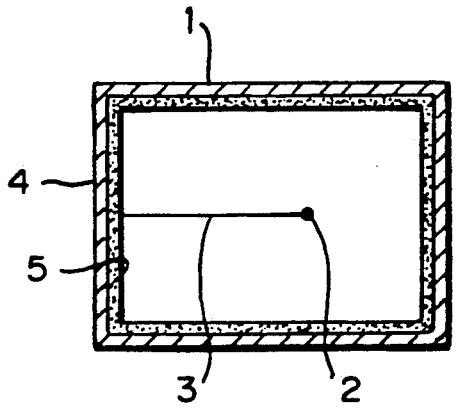
FIG. 1 PRIOR ART
FIGS. 1 and 2 schematically show transverse and longitudinal cross-sections of a portion of a conventional vacuum pipe, respectively.
Figure 2:
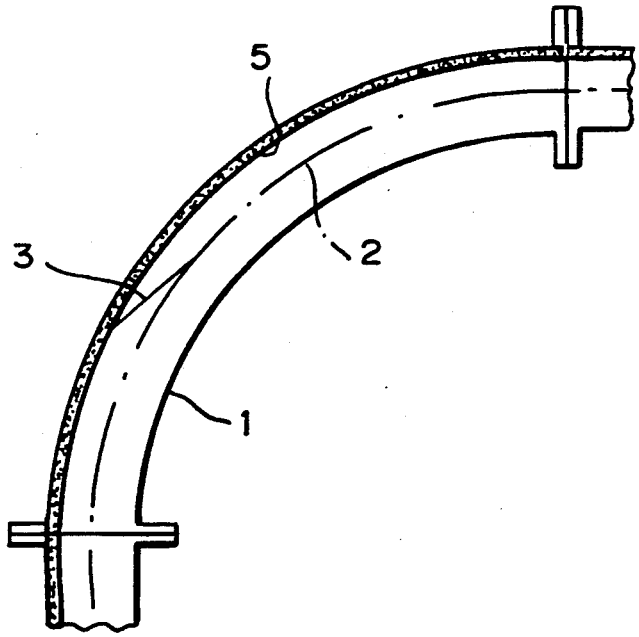
FIG. 2 PRIOR ART

It is certified that error appears in the above-indentified patent and that said Letters Patent is hereby corrected as shown below:

Figures 1 and 2, of sheet 1 of 4, should be deleted and substitute figures 1 and 2 as shown below:

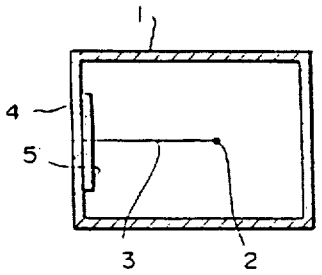

FIG. 1 PRIOR ART

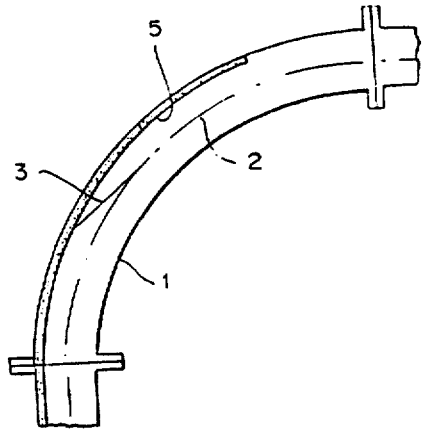

FIG. 2 PRIOR ART

Signed and Sealed this

Eleventh Day of October, 1994

*Attest:*

*Attesting Officer*

BRUCE LEHMAN

*Commissioner of Patents and Trademarks*